US007768183B2

(12) United States Patent
Callahan et al.

(10) Patent No.: US 7,768,183 B2
(45) Date of Patent: Aug. 3, 2010

(54) EXTENSION SPARK PLUG

(75) Inventors: Richard E. Callahan, Maumee, OH (US); Ellen M. Hively, Ann Arbor, MI (US)

(73) Assignee: Federal Mogul World Wide, Inc., Southfield, MI (US)

( * ) Notice: Subject to any disclaimer, the term of this patent is extended or adjusted under 35 U.S.C. 154(b) by 350 days.

(21) Appl. No.: 11/516,920

(22) Filed: Sep. 6, 2006

(65) Prior Publication Data

US 2008/0054777 A1 Mar. 6, 2008

(51) Int. Cl.
*H01T 13/20* (2006.01)

(52) U.S. Cl. ..... 313/137; 313/143; 313/144

(58) Field of Classification Search ..... 313/118–145; 123/169 R, 169 EL, 32, 41, 310
See application file for complete search history.

(56) References Cited

U.S. PATENT DOCUMENTS

| | | | | |
|---|---|---|---|---|
| 2,129,961 | A | 9/1938 | Rabezzana | |
| 2,186,039 | A | 1/1940 | Peters et al. | |
| 2,258,810 | A | 10/1941 | Rabezzana et al. | |
| 2,262,769 | A | 11/1941 | King | |
| 2,303,389 | A | 12/1942 | Rabezzana | |
| 2,632,132 | A | 3/1953 | Delano | |
| 3,050,658 | A | 8/1962 | Lay et al. | |
| 3,330,985 | A | 7/1967 | Johnston | |
| 3,334,326 | A | 8/1967 | Besore et al. | |
| 4,123,688 | A | 10/1978 | Yoshikawa et al. | |
| 4,145,106 | A | 3/1979 | Livingston | |
| 4,163,597 | A | 8/1979 | Brenholts | |
| 4,568,855 | A * | 2/1986 | Nemeth et al. | 315/59 |
| 4,736,718 | A * | 4/1988 | Linder | 123/267 |
| 4,764,703 | A * | 8/1988 | Meyer | 313/126 |
| 4,841,925 | A * | 6/1989 | Ward | 123/143 B |
| 6,111,345 | A * | 8/2000 | Shibata et al. | 313/141 |
| 2006/0181185 | A1 * | 8/2006 | Yamanaka et al. | 313/144 |

FOREIGN PATENT DOCUMENTS

DE 196 11 283 C1 10/1997

(Continued)

OTHER PUBLICATIONS

STITT Spark Plug Company, 2000 Catalog of "NTI," "CES" and "E" Style Spark Plug Recommendations, Total of 38 pages, Conroe, Texas.

*Primary Examiner*—Peter J Macchiarolo
*Assistant Examiner*—Donald L Raleigh
(74) *Attorney, Agent, or Firm*—Robert L. Stearns; Dickinson Wright, PLLC

(57) ABSTRACT

An extension-type spark plug (10) is disclosed for igniting the air-fuel mixture in an internal combustion engine. The spark plug (10) includes an installation conduit (12), a contact button (34), an electrode extension (20), a firing electrode (60), a ground plate (66), a sleeve insulator (22), an upper insulator (90) and a lower insulator (50). The electrode extension (20) is axially aligned with and in communication with the firing electrode (60). The ground plate (66) is proximate the firing electrode (60) to define a spark gap between the firing electrode (60) and a first end of the ground plate (66). The sleeve insulator (22) surrounds the electrode extension (20). The upper insulator (90) surrounds an upper portion of the electrode extension (20) and is in contact with the sleeve insulator (22). The lower insulator (50) surrounds the lower portion of the electrode extension (20) and is in contact with the sleeve insulator (22).

13 Claims, 2 Drawing Sheets

FOREIGN PATENT DOCUMENTS

GB 161720 A 4/1921

GB 725365 A 4/1953

* cited by examiner

EXTENSION SPARK PLUG

CROSS REFERENCE TO RELATED APPLICATIONS

NONE.

BACKGROUND OF THE INVENTION

1. Field of the Invention

The present invention relates to spark plugs for igniting combustion gases in a combustion chamber of an internal combustion engine, and more particularly toward an extension type spark plug as used chiefly in specialized applications.

2. Related Art

Spark plugs are used in a variety of applications and are configured along with other accessory parts to fit within a given environment. For example, in a particular application the depth of the bore in the engine may require the use of a separate spark plug extension to connect the spark plug to the spark plug wire. While designs with accessory pieces meet their intended purpose, many problems still exist. For example, spark plug designs having multiple pieces require complex training and cause logistic issues. Further, the more complex designs require retrofit instructions. Moreover, such designs having multiple pieces require field assembly and, thus, have a reduced reliability.

Therefore, it would be desirable to reduce the number of components necessary to install a spark plug in a given environment to reduce assembly complexity. Moreover, the new and improved designs should provide a more reliable spark plug.

SUMMARY OF THE INVENTION

In accordance with an aspect of the present invention, an extension-type spark plug is provided for igniting the air-fuel mixture in an internal combustion engine (ICE). The spark plug includes an installation conduit, a contact button, an electrode extension, a firing electrode, a ground plate, an insulator sleeve, an upper insulator, and a lower insulator. The installation conduit serves to mechanically contain the components and bears the torque of installing the plug to the engine. The contact button delivers the high voltage pulse from the external source and to the electrode extension. The electrode extension is both axially aligned and in communication with the firing electrode. The ground plate is proximate the firing electrode so as to define a spark gap between the firing electrode and a first end of the ground plate. The sleeve insulator surrounds the electrode extension. The upper insulator surrounds an upper portion of the electrode extension and is in contact with the sleeve insulator. The lower insulator surrounds the lower portion of the electrode extension and is in contact with the sleeve insulator.

In accordance with another aspect of the present invention, the spark plug includes a contact button axially aligned and in contact with the electrode extension.

In accordance with another aspect of the present invention, the spark plug includes a gasket disposed between the contact button and the firing electrode.

In accordance with still another aspect of the present invention, the contact button of the spark plug includes threads for engaging mating threads in the electrode extension.

In accordance with still another aspect of the present invention, the spark plug includes an installation conduit surrounding the upper and lower insulators.

In accordance with still another aspect of the present invention, the spark plug includes an end bushing secured to an end of the installation conduit for connecting an electrical conductor to the electrode contact button.

In accordance with still another aspect of the present invention, the upper insulator has a plurality of portions having different diameters.

In accordance with still another aspect of the present invention, the lower insulator has a plurality of portions having different diameters.

In accordance with still another aspect of the present invention, the upper insulator includes a cavity for receiving a first end of the sleeve insulator.

In accordance with still another aspect of the present invention, the lower insulator includes a cavity for receiving a second end of the sleeve insulator.

BRIEF DESCRIPTION OF THE DRAWINGS

These and other features and advantages of the present invention will become more readily appreciated when considered in connection with the following detailed description and appended drawings, wherein.

DETAILED DESCRIPTION OF THE PREFERRED EMBODIMENT

Figure 1:
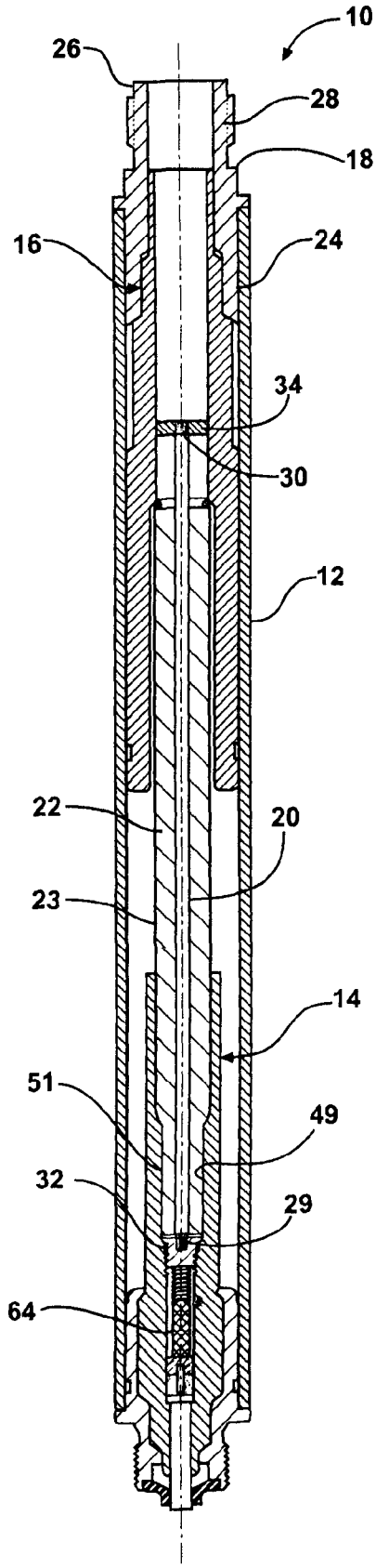
FIG. 1 is a cross-sectional view through an extension spark plug, in accordance with an embodiment of the present invention.

Referring now to FIG. 1, a cross-sectional view of an extension-type spark plug 10 is illustrated, in accordance with an embodiment of the present invention. The spark plug 10 is of the type used in industrial engine and other specialized applications where access to the spark plug 10 for maintenance and replacement purposes is severely limited. The spark plug 10 includes an installation conduit 12. Installation conduit 12 is made of a metal material such as stainless steel or some alloy of steel. Installation conduit 12 houses a lower assembly, generally indicated at 14, and an upper assembly, generally indicated at 16. Both the lower 14 and upper 16 assemblies are made, at least in part, from a dielectric material such as ceramic.

Lower assembly 14 and upper assembly 16 together support an electrically conductive electrode extension 20 which, in one exemplary embodiment, comprises a stiff metallic wire. In one version of the invention, the electrode extension 20 comprises a 0.125 inch diameter wire made from a nickel-based alloy such as is commonly used in center electrode constructions for spark plugs. Electrode extension 20 is surrounded by a sleeve insulator 22 which, together with the dielectric portions of the lower 14 and upper 16 assemblies, prevents electrical conduction between the charged electrode extension 20 and the grounded installation conduit 12. Sleeve insulator 22 is made of a non-conducting material such as a silicone rubber or polymer and as best illustrated in FIG. 1, has a first end surrounded by the upper assembly 16, a second end surrounded by the lower assembly 14, and a central section 23 which is directly exposed by the spacing between the assemblies 14, 16 to the surrounding metallic installation conduit 12.

A bushing 18 is connected at a first bushing end 24 to installation conduit 12 by welding, crimping, or other attachment means. The other end 26 of bushing 18 includes threads 28 for connecting to a spark plug wire (not shown). As conventionally known, the spark plug wire is connected to an external energy source. The bushing 18 possesses a hexagon segment configuration compatible with industry standard socket wrench tooling for installation/removal purposes. The bushing 18 is preferably metallic and is electrically connected to ground through the metallic installation conduit 12.

Electrode extension 20 includes a threaded first end 29 and a threaded second end 30. First end 29 of electrode extension 20 is threaded into a terminal stud 32, whereas the second end 30 is threaded into a contact button 34. The contact button 34 is provided for establishing electrical contact with a leading end of an ignition wire (not shown) according to known coupling techniques. Terminal stud 32 and contact button 34 are generally made of aluminum or a similar metal alloy; however, any electrically conductive material suitable for the purpose may be used as indicated.

Figure 2A:
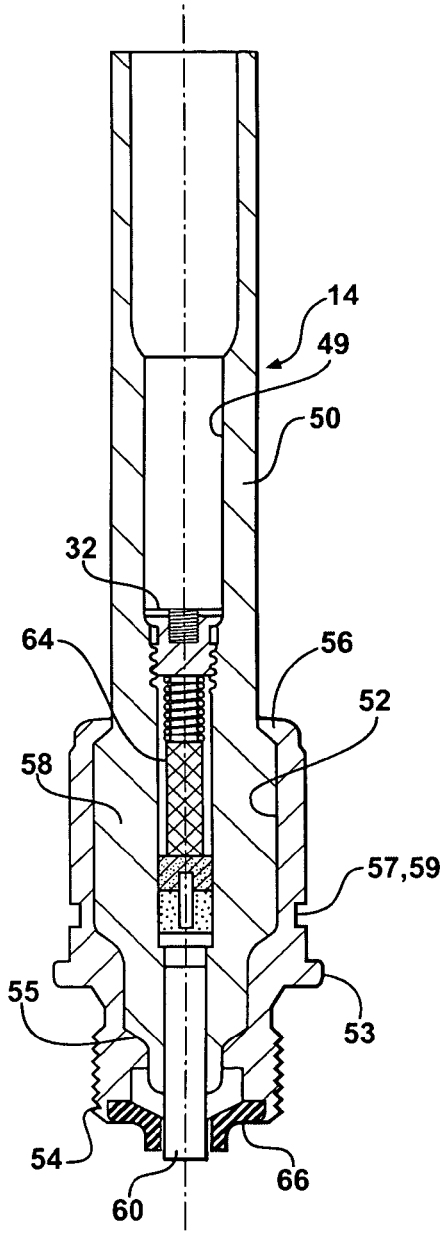
FIG. 2A is a cross-sectional view of an internal portion of the spark plug, in accordance with an embodiment of the present invention.
Figure 2B:
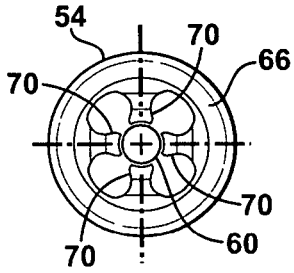
FIG. 2B is an end view of the spark plug, in accordance with an embodiment of the present invention.

Referring now to FIGS. 2A and 2B, lower assembly 14 will now be described in further detail, in accordance with one exemplary embodiment of the present invention. Lower assembly 14 includes the firing end of spark plug 10. A high voltage pulse from an external ignition system is applied to lower assembly 14 through the electrode extension 20. Lower assembly 14 includes a lower insulator 50 for preventing the high voltage pulse supplied to spark plug 10 from leaking between electrode extension 20 and installation conduit 12. Lower insulator 50 has a cavity 49 for receiving a first end 51 of sleeve insulator 22. Lower insulator 50 is typically made of alumina ceramic or a similar material. Lower insulator 50 is captured by a lower shell 52. Lower shell 52 has a first end 54 that is threaded to engage a bore in the engine (not shown). Lower insulator 50 has a lower seat 55. Lower seat 55, when positioned within lower shell 52, is pressed against a complementary ledge or seat in lower shell 52. A second end 56 of lower shell 52 engages lower insulator 50 at an upper shoulder 58 of insulator 50. Thus, the insulator 50 is retained within lower shell 52 by crimping end 56 over shoulder 58 while the lower seat 55 bears against the complementary ledge. An annular groove 57 is disposed in lower shell 52 to define a narrowed wall section 59. Narrowed wall section 59 is influenced by electrically applied localized heat along with overwhelming pressure applied to the ends of lower shell 52 to cause wall 59 to deflect or buckle outward. The affected wall section 59 causes lower shell 52 to decrease in length. The decreased length of lower shell 52 creates a predefined pressure on lower insulator 50 holding the insulator firmly in place within the lower shell 52.

A firing electrode 60 is disposed near first end 54 of lower shell 52. Electrode extension 20 is connected to and supplies voltage to firing electrode 60 through the terminal stud 32, a compression spring, a radio frequency suppressor capsule 64, and a conductive glass seal. Those of skill will appreciate various other intermediate conduction path configurations between the terminal stud 32 and the firing electrode 60. For one example, a fired-in suppressor seal pack may be substituted. Other constructions are also possible. The suppressor capsule 64 or other RFI device is provided to reduce the effects of electromagnetic interference (EMI) on peripheral devices such as radios. A ground plate 66 surrounds firing electrode 60 and is welded, crimped, or otherwise attached to end 54 of shell 52. As will be described hereinafter, a spark gap is defined by the clearance between firing electrode 60 and ground plate 66. The tip of the firing electrode 60 facing the spark gap may be provided with a precious metal insert to improve service life.

An end view of firing electrode 60 and ground plate 66 is shown in FIG. 2B. The ground plate 66 includes a plurality of prongs 70 which extend inwardly toward firing electrode 60. The clearance between each end of the inwardly extending prongs 70 and the firing electrode 60 defines the spark gap over which a spark is created. The tips of the prongs 70, like that of the firing electrode 60, may be fitted with precious metal for durability. Also, other constructions of the ground electrode 66 may be used, such as a full annular spark gap or other than four prongs 70.

Figure 3:
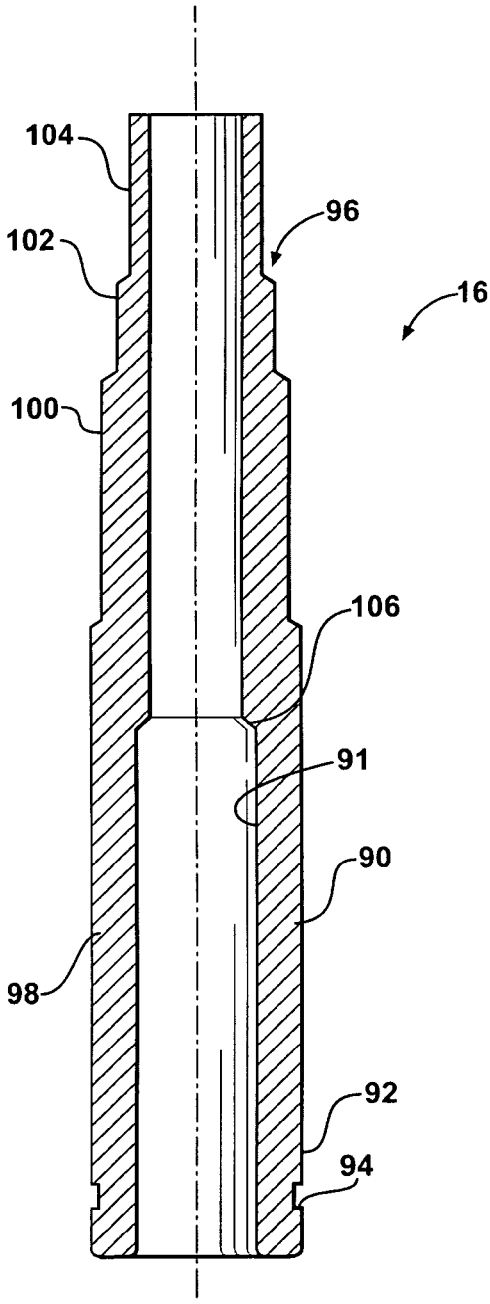
FIG. 3 is a cross-sectional view of the insulator of the spark plug, in accordance with an embodiment of the present invention.

Referring now to FIG. 3, upper assembly 16 is further illustrated, in accordance with an embodiment of the present invention. Upper assembly 16 includes an upper insulator 90 which has a first end 92. Near first end 92 is an annular groove 94. Annular groove 94 is configured to receive an o-ring style sealing gasket (not shown). The sealing gasket seals and positions upper insulator 90 within the installation conduit 12. Near the other end 96 of upper insulator 90 is a series of stepped-down portions having progressively smaller diameters. More specifically, upper insulator 90 includes a first diameter portion 98, a second diameter portion 100, a third diameter portion 102, and a fourth diameter portion 104. The inner diameter of portions 100, 102 and 104 are the same dimension, whereas the inner diameter of portion 98 is larger than the diameter of portions 100, 102 and 104. As shown in FIG. 1, the various diameter changes in the upper assembly 16 cooperate with corresponding features in the bushing 18, installation conduit 12, sleeve insulator 22 and lower assembly 14 so as to combine into a nested arrangement of components that form a unitary structure. Further, upper insulator 90 includes a transitional region or seat 106 disposed within a cavity 91. Seat 106 is configured to receive a seating gasket (depicted as an o-ring) to seat sleeve insulator 22 thereagainst.

During assembly, upper insulator 90 is positioned within installation conduit 12 and moved toward lower assembly 14 until sleeve insulator 22 contacts seat 106. The contact of sleeve insulator 22 and seat 106 prevents further movement of upper insulator 90 toward lower insulator 50. Bushing 18 is then placed into installation conduit 12 until the interior walls of bushing 18 contact the exterior walls of upper insulator 90 at end 96. Bushing 18 is then welded or otherwise mechanically fastened to installation conduit 12 so as to secure upper insulator 90 within installation conduit 12.

The foregoing invention has been described in accordance with relevant legal standards; thus, the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

What is claimed is:

1. A spark plug comprising:

an electrode extension having both an upper portion for being selectively connected to an energy source and a lower portion;

a firing electrode substantially axially aligned and in communication with the lower portion of the electrode extension;

a ground plate situated proximate to the firing electrode so as to define a spark gap between the firing electrode and the ground plate;

a sleeve insulator surrounding the electrode extension and having a first end and a second end and a central section;

an upper insulator surrounding both the upper portion of the electrode extension and the first end of the sleeve insulator so as to be in contact with the sleeve insulator;

a lower insulator surrounding both the lower portion of the electrode extension and the second end of the sleeve insulator so as to substantially be in contact with the sleeve insulator;

a metallic conduit surrounding the upper and lower insulators and the sleeve insulator; and wherein the upper and lower insulators are spaced axially from one another across the central section of the sleeve insulator such that the central section is exposed directly to the surrounding metal conduit.

2. A spark plug as set forth in claim 1, the spark plug further comprising a metallic contact button that is substantially axially aligned and in contact with the upper portion of the electrode extension.

3. A spark plug as set forth in claim 2, wherein the metallic contact button includes threads for engaging threads defined in the upper portion of the electrode extension.

4. A spark plug as set forth in claim 2, the spark plug further comprising an end bushing that is secured to an upper end of the metallic conduit for thereby connecting an electrical conductor to the contact button.

5. A spark plug as set forth in claim 1, wherein the upper insulator has a plurality of portions having different diameters.

6. A spark plug as set forth in claim 1, wherein the lower insulator has a plurality of portions having different diameters.

7. A spark plug as set forth in claim 1, wherein the upper insulator includes a cavity for receiving the first end of the sleeve insulator.

8. A spark plug as set forth in claim 1, wherein the lower insulator includes a cavity for receiving the second end of the sleeve insulator.

9. A spark plug as set forth in claim 1, wherein the lower insulator at least partially surrounds the firing electrode.

10. A spark plug as set forth in claim 1, the spark plug further comprising a shell in which both the firing electrode and the lower insulator are at least partially retained.

11. A spark plug as set forth in claim 10, wherein the shell further retains a radio-frequency suppressor device.

12. A spark plug as set forth in claim 10, wherein the ground plate is attached to the shell.

13. A spark plug as set forth in claim 1, wherein the ground plate surrounds the firing electrode and includes a plurality of prongs that extend toward the firing electrode.

* * * * *